United States Patent [19]

Liptow

[11] 3,982,145

[45] Sept. 21, 1976

[54] FILAMENT SUPPORTS FOR TUBULAR ELECTRIC INCANDESCENT LAMPS

[75] Inventor: Jerome M. Liptow, South Euclid, Ohio

[73] Assignee: General Electric Company, Schenectady, N.Y.

[22] Filed: Feb. 24, 1975

[21] Appl. No.: 552,102

[52] U.S. Cl. ..... 313/274; 313/271; 313/279

[51] Int. Cl.[2] ..... H01J 1/16; H01J 17/50; H01K 1/18

[58] Field of Search ..... 313/274–279, 313/271

[56] References Cited

UNITED STATES PATENTS

| | | | |
|---|---|---|---|
| 3,039,015 | 6/1962 | Jolly | 313/279 |
| 3,119,946 | 1/1964 | Kerstetter et al. | 313/279 X |
| 3,223,875 | 12/1965 | Eggers | 313/271 X |
| 3,392,299 | 7/1968 | Kern | 313/274 X |
| 3,442,302 | 5/1969 | Brady et al. | 313/274 X |
| 3,784,865 | 1/1974 | Shanks | 313/274 |

*Primary Examiner*—Saxfield Chatmon, Jr.
*Attorney, Agent, or Firm*—Ernest W. Legree; Lawrence R. Kempton; Frank L. Neuhauser

[57] ABSTRACT

An electric incandescent lamp comprising an axially extending filament in a tubular vitreous envelope has improved filament supports of wire whose outer turns are formed as hexagonal loops comprising straight segments with angles between successive segments. The sharp bends at the angles decrease the springback and unwinding of the support when it is released from the mandrel, so that variations in support loop diameter with wire tension and size are reduced. The support may be fabricated through a new method and apparatus on a forming mandrel by engaging a wire in a slot in an exposed end face simulating a shallow helicoid. As the mandrel revolves, at least one full turn is wound around its periphery (which may be hexagonal) to form the outer envelope-engaging loop. The wire is then bent radially inwards at the shoulder of the projecting portion of the helicoid face to wind filament-engaging turns around the filament and wire mandrel which extend through an axially aligned aperture in the forming mandrel. The formed support anchored to the filament is then stripped laterally off the exposed end face of the mandrel.

5 Claims, 13 Drawing Figures

FILAMENT SUPPORTS FOR TUBULAR ELECTRIC INCANDESCENT LAMPS

This invention relates to electric incandescent lamps of the kind having an axially extending helically coiled filament in a tubular elongated envelope, and more particularly to the wire support members for maintaining the filament in place.

BACKGROUND OF THE INVENTION

The wire supports to which the invention is directed have been used with good results in the well-known tungsten halogen type of lamp which comprises an elongated tubular envelope having an axially extending filament. These lamps are frequently referred to as quartz iodine lamps and are available in T2, T2½, T3 and T4 sizes, the numeral indicating the external diameter of the envelope measured in eights of an inch. The lamps are very compact and are made in various wattage ratings up to several thousand watts. Their spectral emission is such that they can be used either as light or heat sources.

The wire support members are anchored to the filament at spaced points and include an outer loop disposed in encircling spaced-apart relationship which engages the envelope wall to maintain the filament on axis. Such supports, and a coiling spindle or mandrel for winding and installing them on the filament are shown in U.S. Pat. No. 3,168,670 to V. C. Levand. Improved more automated apparatus for coiling and installing such wire supports and which is more economical of the quantity of wire used is disclosed in U.S. Pat. No. 3,556,169 to J. B. Yoder.

An ever present problem with the support designs and apparatus available up to now has been springback of the wire upon severing the finished support from the supply or upon release from the forming mandrel or spindle. The wire is resilient and must be so in order to adequately perform its support function. Inevitably this means that the outer turn of the support which is disposed in encircling relationship to the filament unwinds and expands in diameter upon release. By way of typical example, in a spiral-wound wire support such as formed by the Yoder apparatus, the expansion of the outer turn upon release from the forming mandrel may be as much as 30%. The outer turn of the supports must be sized to enter readily into the lamp envelope at assembly and fit snugly without excessive play. Accordingly, a winding mandrel is provided of such diameter that the support is properly sized after release and springback. However, the difficulty arises from the fact that the degree of springback increases with resiliency and is also an inverse function of wire size. In other words, a finer or a stiffer wire has more springback which must be anticipated in the design or in the machine adjustment. Since the wire size may need to be changed and since unavoidable manufacturing tolerances allow some variations in size and resiliency or temper, maintaining the wire supports within the size limits has been a continuing problem.

SUMMARY OF THE INVENTION

One object of the invention is to provide an improved wire support less subject to springback and therefore less subject to variations in outer turn diameter with wire size and resiliency.

Another object is to provide a more reliable and effective apparatus for efficient and economical forming and installing of such supports on the filament.

According to one aspect of the invention, the outer turn of the wire support is formed as a convex polygonal loop, that is a loop characterized by substantially straight segments with angles or sharp bends between successive segments. In a preferred embodiment, a hexagonal loop is formed. The sharp bends in the wire at the angles of the hexagon sharply decrease the springback and unwinding of the support when it is released from the forming spindle, so that variations in support loop diameter with wire size and resiliency and with winding tension are reduced.

In an improved method and apparatus for forming supports and attaching them to the filament, the support member is fabricated from wire by engaging it in a slot in the face of a pierced forming mandrel, suitably but not necessarily hexagonal, through which the filament, helically wound on a mandrel wire, extends. The face of the forming mandrel simulates a helicoid so proportioned that as it revolves, at least one full turn winds around the forming mandrel to form the outer envelope-engaging loop. Thereafter, the wire bends off a projecting shoulder of the helicoid and continues to wind around the mandrel wire to form several turns interleaved with the filament turns. Finally a few turns of reversed helical sense are wound over the interleaved turns to form a locking overwind and the support is stripped laterally off the forming mandrel.

For the smaller diameter lamps, for instance the T2 size, a polygonal mandrel is not necessary and I have found a cylindrical mandrel satisfactory, for instance a 0.10 inch mandrel for this size. Since the mandrel is smaller, the wire is bent more sharply and takes more set so that there is proportionately less springback upon release. However my improved apparatus and method may be used with both polygonal and circular section forming mandrels.

DETAILED DESCRIPTION

Figure 1:
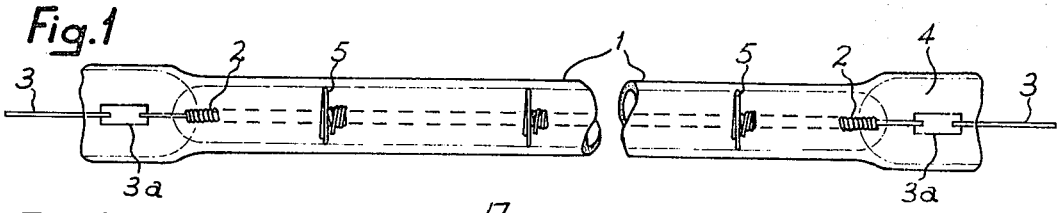
FIG. 1 is a side view, partly diagrammatic, of a tubular tungsten halogen lamp having support members embodying the invention.

Referring to FIG. 1, there is shown a tungsten halogen type lamp comprising a tubular envelope 1 of fused silica or similar heat-resistant light-transmitting material containing a gas filling such as argon and a small quantity of iodine or bromine vapor. A helically coiled tungsten wire filament 2 extends axially through the envelope and is connected at its ends to inlead conductors 3 including foil portions 3*a* which extend outwardly through compressed pinch seal portions 4 at the ends of the envelope. The filament 2 is maintained in place at the axis by wire supports 5 anchored to the filament at spaced points therealong which engage the inner wall of the envelope.

Figure 2:
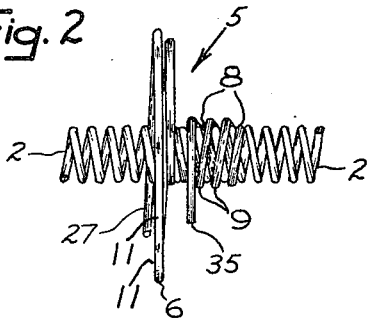
FIG. 2 is a side view on an enlarged scale showing the manner of attachment of a support to the filament coil.

The support members 5 (FIGS. 2 and 3) are formed of wire, generally either tungsten or molybdenum wire, and include an outer loop portion 6 of slightly smaller diameter than the inner diameter of the envelope which is to be engaged by it. The outer loop portion is connected by intermediate radial portion or spoke 7 with a central coil portion engaging the filament coil 2 and including primary helical turns 8, preferably three full turns, which are concentric with and interleaved between turns of the filament coil 2. The primary turns 8 are continued in and terminated by helical locking turns 9, preferably two full turns of opposite helical sense and overlying both the turns of the filament coil 2 and the primary turns 8. The overwind of locking turns 9 prevents the primary turns 8 from sliding through to the opposite side of the filament coil 2 and assures a secure attachment and centering of the support 5 on the filament.

Figure 3:
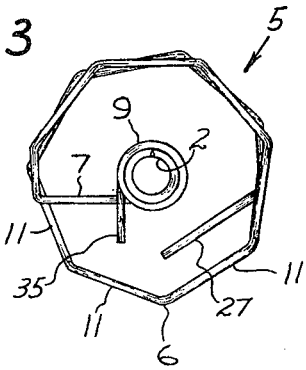
FIG. 3 is an end view of the support structure shown in FIG. 2.

The illustrated outer loop 6 is characterized by substantially straight segments 11 with angles or sharp bends between successive segments. As best seen in FIG. 3, it takes about seven segments to complete 360° of the outer loop. The winding of the outer loop was originally done on a hexagonal mandrel and the increase from six to seven segments, which corresponds to a expansion of approximately 16% indicates the much reduced springback achieved by the invention. This is about half as much expansion upon springback as occurred with the spiral support design such as shown in the Yoder patent.

Figure 4:
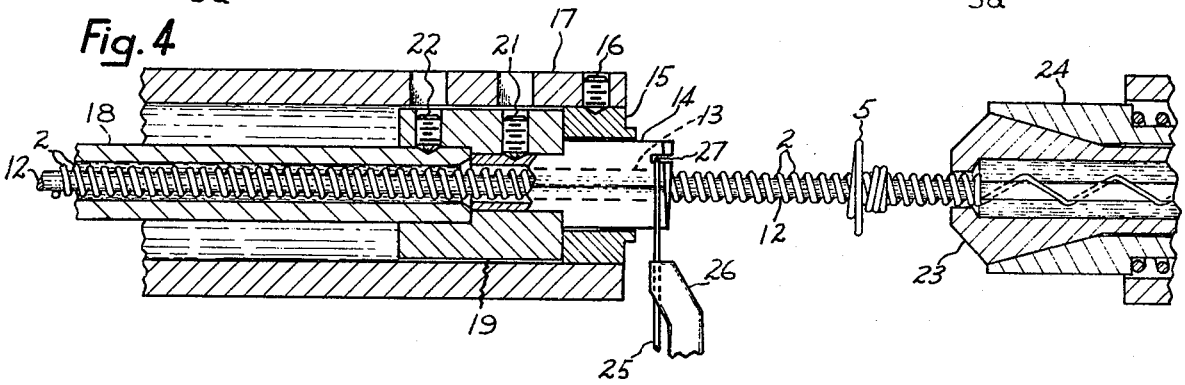
FIG. 4 is a section through the head and tail spindles of the support forming apparatus.
Figure 5:
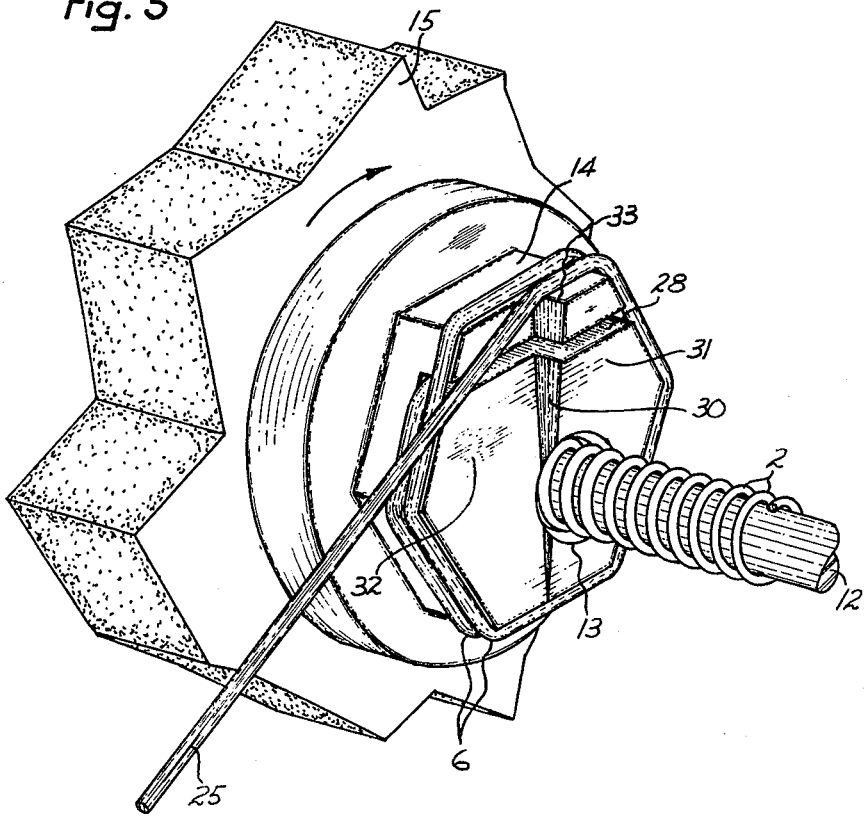
FIG. 5 is a fragmentary enlarged perspective view of the hexagonal forming mandrel in the head spindle of FIG. 4, showing a partially wound support.

The support 5 is formed about and attached directly to the filament coil 2 preferably by a mechanism as shown in FIGS. 4 and 5 according to the sequence and method illustrated in FIGS. 6 to 13. The filament coil 2 contains a close fitting mandrel wire 12 which may be the same one on which it was originally wound. It is inserted into longitudinal bore 13 in rotatable hexagonal forming mandrel 14 which is slidably supported in a stripper sleeve 15 locked by setscrew 16 to head spindle 17. It is the portion of mandrel 14 projecting beyond the stripper which is utilized to wind the support. Mandrel wire 12 with the filament 2 thereon extends through bore 13 and into a control tube 18 in the interior of the head spindle. Forming mandrel 14 and tube 18 both penetrate a collar 19 and all three parts are locked together by setscrews 21, 22. Control tube 18 is moved to the left to withdraw the forming mandrel into stripper 15 whereby to foce a formed support off the mandrel. Collar 19 may also serve to compel mandrel 14 to rotate with spindle 17, as would be necessary when a circular section forming mandrel is used, in which case stripper 15 would of course be modified to conform.

The right hand end of mandrel wire 12 and filament 2 is seized in collet chuck 23 of tail spindle 24 which is driven synchronously with head spindle 17. The tail spindle is movable in an axial direction towards and away from the head spindle to vary the depth to which filament 2 and mandrel wire 12 are inserted into bore 13. The mandrel wire and filament are initially inserted fully into the head spindle, and as each successive wire support is formed and attached, they are drawn out by sliding the tail spindle appropriately to the right. As illustrated in FIG. 4, one wire support 5 has already been formed and anchored on filament 2 and a second is about to be formed.

Figure 6:
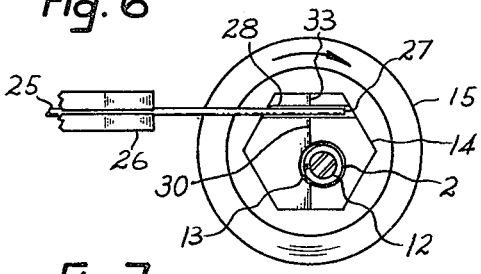
FIGS. 6 and 7 are end and plan views, respectively, of the hexagonal mandrel held in the forming head spindle and showing the first stage in fabricating a wire support.

A wire support is formed and attached to the filament as follows. An appropriate length of wire 25 which is to be formed into the support may be drawn and cut off from a spool (not shown) and gripped by a pair of jaws 26 which insert the leading end 27 into slot 28 in the front face of hexagonal forming mandrel 14, as shown in FIG. 6. The wire makes a snug fit in the slot and as soon as the mandrel begins to revolve, friction resulting from the bend at the exit point binds the wire in the slot. Hexagonal mandrel 14 together with filament 2 on mandrel wire 12 now rotates clockwise when viewed in FIGS. 5 and 6, as indicated by the curved arrows. The jaws 26 restrain wire 25 as it is pulled through and maintain it taut as it wraps around revolving mandrel 14 and forms outer loop 6. At the same time jaws 26 start to move in the direction indicated by arrow 29 in FIG. 9 to guide the wire toward the edge of the mandrel.

Figure 8:
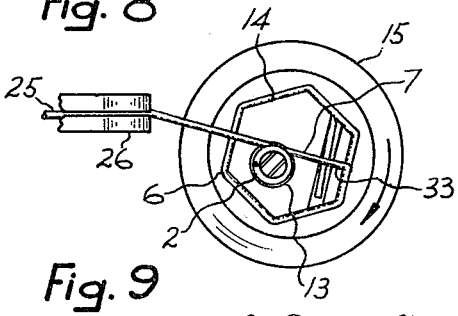
FIGS. 8 and 9, 10 and 11, and 12 and 13, are similar paired views illustrating subsequent stages in the fabrication of the wire support.
Figure 7:
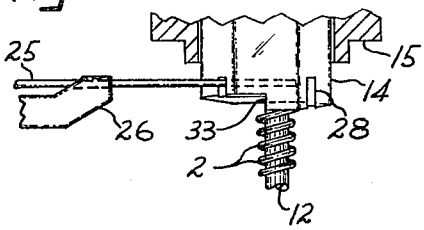
Figure 9:
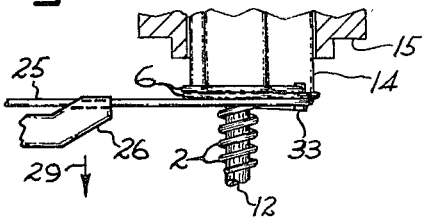

The face of hexagonal mandrel 14 is shaped generally like a shallow helicoid or one-turn screw. Exact helicoid geometry is not necessary and, for ease of machining, an approximation suffices as in the illustrated embodiment. As best seen in FIG. 5, the face is split on an axial plane or step 30, portion 31 to the right leaning from the bottom towards the viewer, and portion 32 to the left leaning away from the viewer. The axial displacement or width of peripheral shoulder 33 is better than one winding thickness of the wire, that is, it is somewhat wider than the diameter of wire 25. Slot 28 into which the wire is inserted is about 2 wire diameters deep when measured at face portion 32 where the depth is least. Thus after two turns have been wound on the forming mandrel, the wire, guided by jaws 26, reaches the edge of shoulder 33 (FIG. 5), bends 90° around the shoulder to extend radially inwards along step 30 and form radial spoke 7 as shown in FIGS. 8 and 9, and then winds around mandrel wire 12. Bore 13 in which mandrel wire 12 is accommodated is displaced below and to the right of the axis of mandrel 14 (FIG. 5). This is in order to have the filament centered in the support when it is removed from the mandrel. Springback causes the outer loop to expand in a counterclockwise manner and the net effect is to center the filament at the axis of outer loop 6 after expansion, as may be seen by comparing FIG. 3 with FIG. 12.

Figure 10:
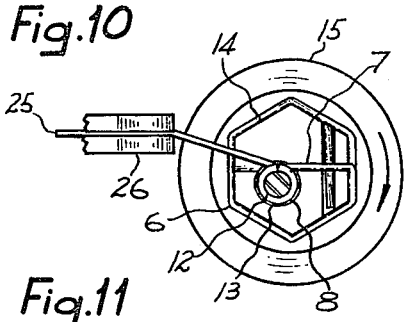
Figure 12:
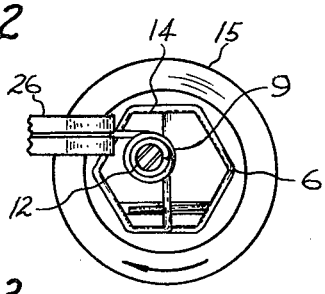
Figure 11:
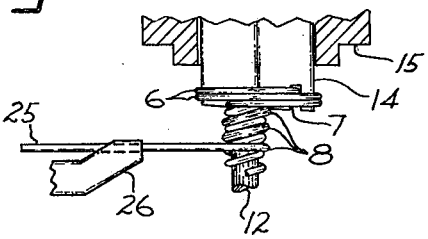
Figure 13:
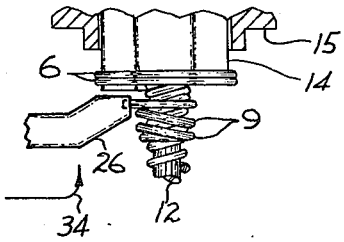

The wire guiding jaws 26 continue their displacement in the direction indicated by arrow 29 in FIG. 9 and the next three turns of the wire are wound on mandrel wire 12 and interleaved between turns of filament coil 2 to form primary anchoring turns 8 best seen in FIGS. 10 and 11. The axial movement of jaws 26 is then reversed and simultaneously they start to move in radially as indicated by bent arrow 34 in FIG. 13. The result is to wind the last two turns in the opposite helical sense to the filament whereby to form the locking overwind 9 as indicated in FIGS. 12 and 13. At the same time, the inward radial displacement of the jaws assures that wire 25 is bent in close to the coil axis before it finally pulls free of the jaws. Thus only a short projecting stub 35 is left which does not interfere with the placement of the support in the lamp envelope.

At this moment the formed support is still tightly wound on forming mandrel 14. It is pushed off the mandrel by moving control tube 18 to the left whereby the mandrel is drawn into stripper 15. This forces the outer loop 6 off the periphery of the mandrel while leading end 27 of the support slides out through open slot 28. Filament 2 on mandrel wire 12 is then withdrawn to the right by movement of tail spindle 24 a distance equal to the spacing between supports, preparatory to forming the next support on the filament. These operations are repeated until the required number of wire supports have been formed and anchored to the filament coil.

When the formed support is stripped off the mandrel, the turns of the outer loop tend to unwind and in so doing expand radially outward so that the major diameter is larger in the unconfined condition after release. Comparing FIGS. 2 and 3 to FIGS. 12 and 13, it will be observed that in the released condition of the support illustrated in the former pair, seven of the hexagonal segments 11 make a full loop or 360° span, while only six are required when wound on the hexagonal forming mandrel as shown in the latter pair. The increase in loop size or major diameter was formerly a constant problem in winding supports. By my invention, the sharp bends in the wire at the angles between straight segments of the hexagon strain the wire beyond its elastic limits at those points, thus "setting" the wire and minimizing unwinding. By way of example, a wire support for a T3 lamp made from 10 mil wire on a prior art round mandrel would expand upon release from 0.214 to 0.275 inch, such being a 30% expansion in diameter. The same support made on a hexagonal mandrel in accordance with the invention expands from 0.232 to 0.270 inch for a 16% expansion in diameter. Thus the unwinding and expansion in diameter has been cut down by about half. A more accurately formed product is obtained and the rejection rate or shrinkage in production is reduced substantially.

What I claim as new and desire to secure by Letters Patent of the United States is:

1. An electric lamp comprising a tubular envelope and a coiled filament extending therethrough and supported intermediate its ends from the inner wall of said envelope by at least one wire support, said support comprising a wire having an outer convex polygonal loop portion characterized by substantially straight segments with sharp bends between successive segments, said outer loop portion engaging the inner wall of said envelope and being connected to a central coiled portion attached to the filament coil.

2. An electric lamp as in claim 1 wherein said central portion includes primary helical turns interleaved between filament turns and locking turns of opposite helical sense overlying said interleaved turns.

3. An electric lamp as in claim 1 wherein said wire is continued from said outer loop portion into a radial spoke and said spoke is continued into said central portion.

4. An electric lamp as in claim 1 wherein said wire is continued from said outer loop portion into a radial spoke and said spoke is continued into said central portion which includes primary helical turns interleaved between filament turns and locking turns of opposite helical sense overlying said interleaved turns.

5. An electric lamp as in claim 1 wherein said outer convex polygonal loop portion is a hexagonal loop sprung back and unwound to a minor extent.

* * * * *